US008207894B2

(12) United States Patent
Betts-LaCroix

(10) Patent No.: US 8,207,894 B2
(45) Date of Patent: Jun. 26, 2012

(54) MULTILAYER COMPACT ANTENNA

(75) Inventor: Jonathan Betts-LaCroix, San Francisco, CA (US)

(73) Assignee: Google Inc., Mountain View, CA (US)

( * ) Notice: Subject to any disclaimer, the term of this patent is extended or adjusted under 35 U.S.C. 154(b) by 472 days.

(21) Appl. No.: 12/554,813

(22) Filed: Sep. 4, 2009

(65) Prior Publication Data

US 2010/0141360 A1 Jun. 10, 2010

Related U.S. Application Data

(60) Provisional application No. 61/096,064, filed on Sep. 11, 2008.

(51) Int. Cl.
*H01Q 1/38* (2006.01)

(52) U.S. Cl. ..... 343/700 MS; 343/702; 343/745

(58) Field of Classification Search ..... 343/700 MS, 343/702, 745

See application file for complete search history.

(56) References Cited

U.S. PATENT DOCUMENTS 7,463,474 B2 * 12/2008 Ritter et al. ..... 361/306.1
7,605,683 B2 * 10/2009 Sawada et al. ..... 338/2
7,630,208 B2 * 12/2009 Lee et al. ..... 361/766

* cited by examiner

*Primary Examiner* — Hoang V Nguyen
(74) *Attorney, Agent, or Firm* — Morris & Kamlay LLP

(57) ABSTRACT

An antenna is provided. The antenna includes a dielectric material including a plurality of layers defined a first set of electrodes of a first polarity and a second set of electrodes of a second polarity, wherein the first set of electrodes and second set of electrodes alternate in position to form the plurality of layers; a first interconnect coupled to the first set of electrodes, the first interconnect coupled to a ground; a second interconnect coupled to the second set of electrodes, the second interconnect coupled to a voltage source, wherein a voltage is applied to the second interconnect to generate an electric field.

12 Claims, 2 Drawing Sheets

MULTILAYER COMPACT ANTENNA

CROSS REFERENCES TO RELATED APPLICATIONS

This application claims priority from U.S. Provisional Patent Application Ser. No. 61/096,064, entitled Multilayer Compact Antenna, filed on Sep. 11, 2009, which is hereby incorporated by reference as if set forth in full in this application for all purposes.

BACKGROUND

Particular embodiments generally relate to antennas.

Conventional systems put a high voltage onto the resonating element in order to impress a strong electric (E) field into a field-tunable ceramic dielectric. In some cases it may be inconvenient to produce a high enough voltage for this purpose.

SUMMARY

An apparatus is provided comprising: a dielectric material including a plurality of layers defined a first set of electrodes of a first polarity and a second set of electrodes of a second polarity, wherein the first set of electrodes and second set of electrodes alternate in position to form the plurality of layers; a first interconnect coupled to the first set of electrodes, the first interconnect coupled to a ground; a second interconnect coupled to the second set of electrodes, the second interconnect coupled to a voltage source, wherein a voltage is applied to the second interconnect to generate an electric field.

A further understanding of the nature and the advantages of particular embodiments disclosed herein may be realized by reference of the remaining portions of the specification and the attached drawings.

DETAILED DESCRIPTION OF EMBODIMENTS

Figure 1:
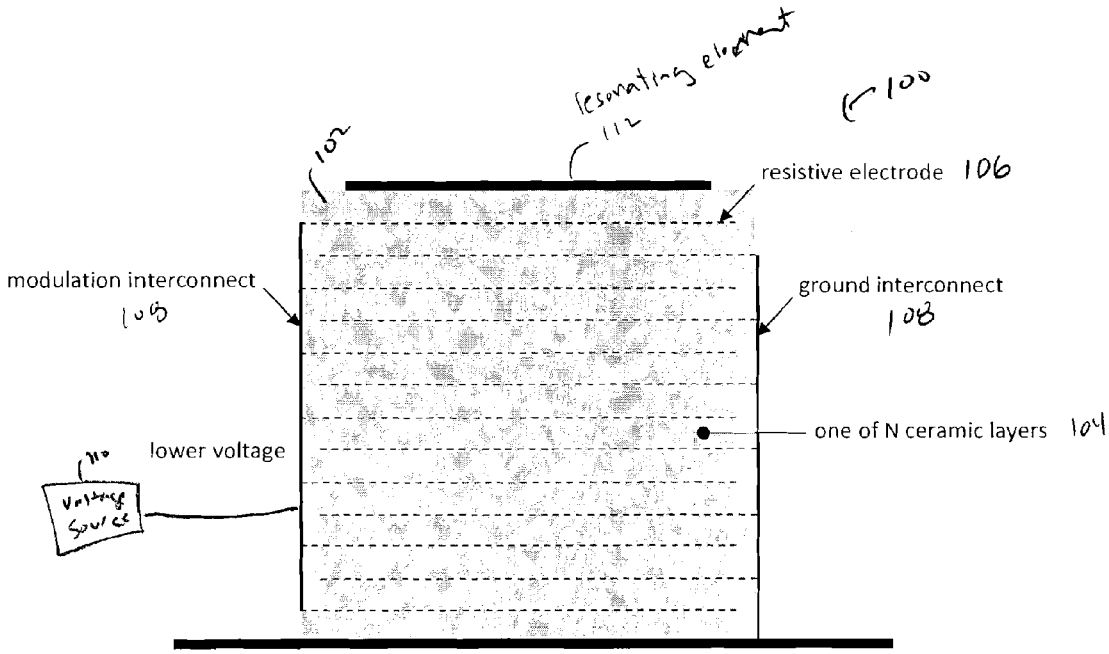
FIG. 1 depicts an example of an antenna according to one embodiment.

FIG. 1 depicts an example of an antenna 100 according to one embodiment. Antenna 100 impresses a strong electric field into a field-tunable ceramic dielectric 102. The electric (E) field modulates the center frequency of tunable antenna 100.

Strong E fields are impressed into dielectric 102 by dividing dielectric 102 into N thin layers 104 bounded by electrodes 106 (thin, dashed lines) of alternating polarity. Since layers 104 are thin, low voltages are able to produce high E-field strengths. Dielectric 102 may be made of a ceramic material.

In one embodiment, electrodes 106 constructed of a highly resistive material. Electrodes 106 do not interfere with the waves produced by the antenna 100. Electrodes 106 comprise a sufficiently high impedance that they absorb only negligible amounts of the energy in the antenna waves, and yet are conductive enough to convey charge into the boundaries between the layers of the dielectric (e.g., ceramic).

In one embodiment, electrodes 106 are constructed using methods similar to those used for producing high-resistance, thin-film, ceramic, chip resistors. Methods for constructing the electrodes may apply thin films of metal to the ceramic layers, such as by sputtering, or chemical vapor deposition.

In one embodiment, electrodes 106 are interconnected by interconnects 108. Interconnects 108 are shown as plating (thin, solid lines of FIG. 2) along the 2 sides of dielectric 102, with one side connecting alternating electrodes to ground, while the other connects the remaining electrodes to a voltage source 110. In one embodiment, voltage source 110 may be a direct current (DC) voltage source that modulates the antenna center frequency.

Interconnects 108 in same cases should also be highly resistive. Other interconnects could be integral to the resonating elements 112 of antenna 110. Resonating elements 112 could provide a ground potential, and effectively serve as one of the electrodes. Similarly, a resonating element 112 could also carry the DC modulating voltage.

By placing a voltage across layers 104, the tuning of the antenna is changed. By putting the voltage across a thinner gap, a larger electric field may be generated. For example, if the same voltage is put across a larger gap, then less electric field is generated. By making layers 104 in dielectric 102, the gap in which voltage is put across is smaller than if no layers were found in dielectric 102. Thus, smaller voltages may be used to generate a similar strength electric field as compared to a dielectric without layers. For devices where large voltages are not feasible, such as in portable devices (e.g., cellular phones, portable computers, laptop computers, etc.), the same electric field may be generated using smaller voltages that may be available in the device.

Antenna 100 may not work if energy of antenna waves is absorbed by electrodes 106. A highly resistive material is used such that electrodes 106 only absorb negligible amounts of antenna waves. However, the highly resistive material is still able to conduct electricity to cause an electric field into layers 104.

Particular embodiments also apply to antenna configurations in which the resonating and/or active conductive elements of the antenna 100 are not only on single-piece conductors on top, but also when they wrap around on the sides of the ceramic and/or include multiple, separate regions.

Figure 2:
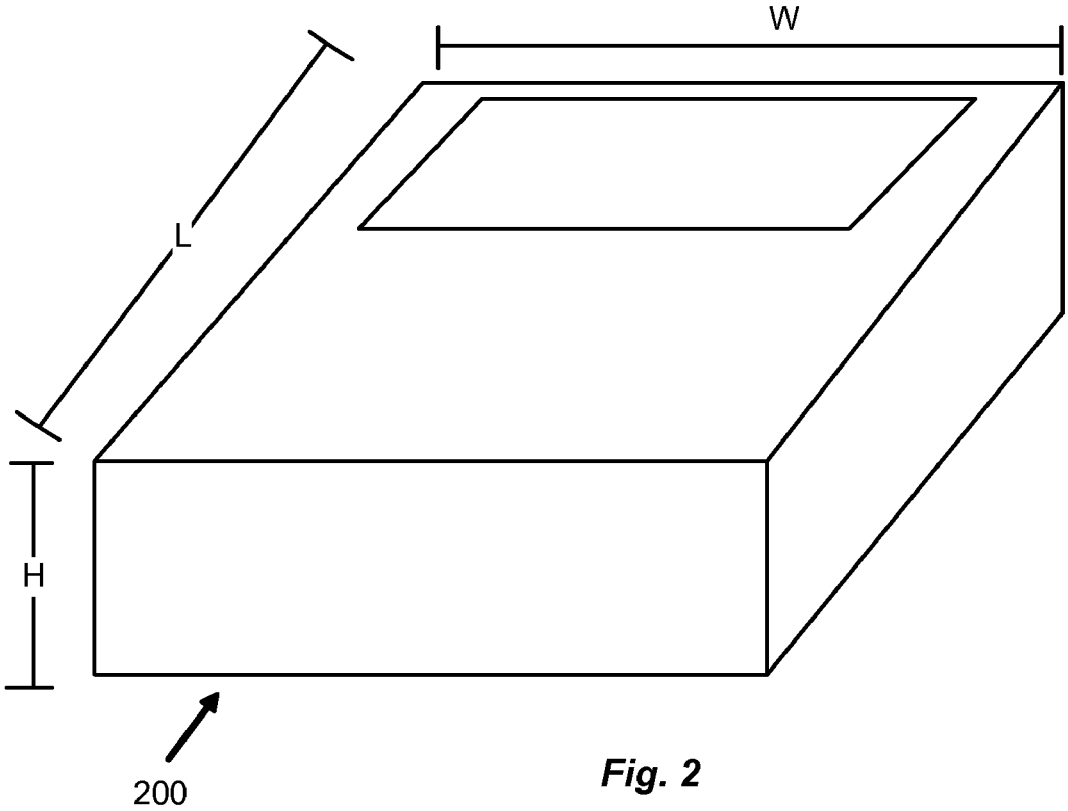
FIG. 2 shows an example device according to one embodiment.

FIG. 2 shows an example device 200 according to one embodiment. In one embodiment, device 200 may be a portable device. For example, device 200 may include a miniature computer, laptop computer, personal computer, personal digital assistant (PDA), cellular telephone, Blackberry device, pocket PC, etc. In other embodiments, device 200 is not limited to portable devices and may be used in any display device, such as a laptop computer, television, DVD display player, etc.

In one embodiment, the dimensions of device 200 may be a length, L, of substantially 4 inches; a width, W, of substantially 3 inches; and a height, H, of substantially ¾ inches. Additionally, the display may be a little under substantially 3 inches wide and substantially 4 inches long.

Device 200 includes antenna 100 and uses that antenna to transmit or receive electromagnetic waves. Antenna 100 converts electromagnetic waves into electrical currents.

Although the description has been described with respect to particular embodiments thereof, these particular embodiments are merely illustrative, and not restrictive. It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

I claim:

1. An apparatus comprising:

a dielectric material including a plurality of layers defined a first set of electrodes of a first polarity and a second set of electrodes of a second polarity, wherein the first set of electrodes and second set of electrodes alternate in position to form the plurality of layers;

a first interconnect coupled to the first set of electrodes, the first interconnect coupled to a ground; and a second interconnect coupled to the second set of electrodes, the second interconnect coupled to a voltage source, wherein a voltage is applied to the second interconnect to generate an electric field.

2. The apparatus of claim 1, wherein the first set and second set of electrodes are constructed of a highly resistive material.

3. The apparatus of claim 2, wherein the first and second set of electrodes absorb a negligible amount of energy from waves of the apparatus.

4. The apparatus of claim 3, wherein the negligible amount does not affect performance of the apparatus to transmit the waves.

5. The apparatus of claim 1, wherein the voltage source comprises a direct current (DC) voltage source.

6. The apparatus of claim 1, wherein the dielectric comprises a ceramic material.

7. The apparatus of claim 1, further comprising a resonating element.

8. The apparatus of claim 7, wherein the resonating element comprises a single conductor on top of the apparatus.

9. The apparatus of claim 8, wherein the resonating element is wrapped around sides of the apparatus.

10. The apparatus of claim 1, wherein the apparatus comprises an antenna.

11. The apparatus of claim 1, wherein the apparatus is included in a portable device.

12. A portable computing device comprising:

an antenna comprising:

a dielectric material including a plurality of layers defined a first set of electrodes of a first polarity and a second set of electrodes of a second polarity, wherein the first set of electrodes and second set of electrodes alternate in position to form the plurality of layers;

a first interconnect coupled to the first set of electrodes, the first interconnect coupled to a ground; and a second interconnect coupled to the second set of electrodes, the second interconnect coupled to a voltage source, wherein a voltage is applied to the second interconnect to generate an electric field.

* * * * *